US008230846B2

(12) United States Patent
Fujiwara et al.

(10) Patent No.: US 8,230,846 B2
(45) Date of Patent: Jul. 31, 2012

(54) AIR-FUEL RATIO CONTROL DEVICE FOR INTERNAL COMBUSTION ENGINE

(75) Inventors: Takahiko Fujiwara, Susono (JP); Hiroaki Mizoguchi, Susono (JP); Norihisa Nakagawa, Numazu (JP); Taiga Hagimoto, Susono (JP); Naoto Kato, Susono (JP); Shuntaro Okazaki, Susono (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 680 days.

(21) Appl. No.: 12/448,346

(22) PCT Filed: Apr. 8, 2008

(86) PCT No.: PCT/JP2008/056953

§ 371 (c)(1),
(2), (4) Date: Jun. 18, 2009

(87) PCT Pub. No.: WO2008/126845

PCT Pub. Date: Oct. 23, 2008

(65) Prior Publication Data

US 2009/0314268 A1 Dec. 24, 2009

(30) Foreign Application Priority Data

Apr. 9, 2007 (JP) ..... 2007-101768

(51) Int. Cl.
*F02D 41/04* (2006.01)
*F02D 41/00* (2006.01)

(52) U.S. Cl. ..... 123/696; 123/693

(58) Field of Classification Search ..... 123/703, 123/693, 694, 696, 688; 701/109; 60/276, 60/277

See application file for complete search history.

(56) References Cited

U.S. PATENT DOCUMENTS 5,315,823 A 5/1994 Nishikawa et al.
5,875,628 A * 3/1999 Mitsutani ..... 60/276

(Continued)

FOREIGN PATENT DOCUMENTS

JP A-63-94049 4/1988

(Continued)

OTHER PUBLICATIONS

Mar. 30, 2010 Office Action issued in Japanese Patent Application No. 2007-101768 (with translation).

*Primary Examiner* — Mahmoud Gimie
(74) *Attorney, Agent, or Firm* — Oliff & Berridge, PLC

(57) ABSTRACT

The present invention relates to an air-fuel ratio control device for an internal combustion engine, and makes it possible to maintain high purification performance by suppressing a decrease in the oxygen occlusion capability of a catalyst. When an $O_2$ sensor output oxs is greater than a reference value oxsref, which corresponds to a stoichiometric air-fuel ratio, and smaller than an upper threshold value oxsrefR, a sub-FB reflection coefficient is fixed at a predetermined value vdox2 for providing a lean air-fuel ratio. When, on the other hand, the $O_2$ sensor output oxs is smaller than the reference value oxsref and greater than a lower threshold value oxsrefL, the sub-FB reflection coefficient is fixed at a predetermined value vdox2 for providing a rich air-fuel ratio. The sub-FB reflection coefficient reflects the $O_2$ sensor output oxs in the calculation of a fuel injection amount and increases or decreases to have a consequence on the air-fuel ratio of an exhaust gas.

7 Claims, 2 Drawing Sheets

U.S. PATENT DOCUMENTS

| | | | | |
|---|---|---|---|---|
| 6,546,719 | B2 | 4/2003 | Kamoto et al. | |
| 6,877,498 | B1 * | 4/2005 | Matsushima et al. | 123/690 |
| 7,270,119 | B2 * | 9/2007 | Mitsutani | 123/674 |
| 2002/0112467 | A1 | 8/2002 | Uranishi | |
| 2002/0157381 | A1 * | 10/2002 | Kakuyama et al. | 60/276 |
| 2006/0185655 | A1 * | 8/2006 | Mitsutani | 123/674 |
| 2007/0000482 | A1 * | 1/2007 | Tamura et al. | 123/687 |
| 2007/0089398 | A1 * | 4/2007 | Fujiwara et al. | 60/277 |

FOREIGN PATENT DOCUMENTS

| | | |
|---|---|---|
| JP | A-05-033705 | 2/1993 |
| JP | A-10-246139 | 9/1998 |
| JP | A-2002-115590 | 4/2002 |
| JP | A-2002-317678 | 10/2002 |
| JP | A-2003-314334 | 11/2003 |
| JP | A-2005-188330 | 7/2005 |

* cited by examiner

AIR-FUEL RATIO CONTROL DEVICE FOR INTERNAL COMBUSTION ENGINE

TECHNICAL FIELD

The present invention relates to an air-fuel ratio control device for an internal combustion engine, and more particularly to an air-fuel ratio control device for an internal combustion engine having an exhaust path in which a catalyst capable of occluding oxygen is installed.

BACKGROUND ART

Catalysts used for exhaust gas purification in an internal combustion engine have an oxygen occlusion capability for occluding oxygen in them. When the air-fuel ratio of an exhaust gas flowing into a catalyst is lean, the catalyst occludes oxygen in the gas. When, on the other hand, the air-fuel ratio of the exhaust gas flowing into the catalyst is rich, the catalyst releases the occluded oxygen into the gas. Therefore, when the exhaust gas has a lean air-fuel ratio and contains a relatively large amount of NOx as compared with HC and CO, the catalyst occludes oxygen to reduce NOx. When, on the other hand, the exhaust gas has a rich air-fuel ratio and contains a relatively large amount of HC and CO, the catalyst releases oxygen to oxidize HC and CO.

However, if the air-fuel ratio of the exhaust gas flowing into the catalyst continues to deviate toward the lean side, the oxygen occluded by the catalyst reaches saturation before long so that NOx cannot be purified. If, in contrast, the air-fuel ratio continues to deviate toward the rich side, the oxygen occluded by the catalyst is depleted before long so that HC and CO cannot be purified. Under such circumstances, conventional internal combustion engines exercise fuel injection amount feedback control in accordance with an oxygen sensor output value to ensure that the oxygen occluded by a catalyst is maintained in an appropriate state.

The oxygen occluded by a catalyst can be monitored when an oxygen sensor is installed downstream of the catalyst. When the oxygen in the catalyst is saturated, the output value generated from the oxygen sensor changes from rich to lean. When, in contrast, the oxygen in the catalyst is depleted, the output value generated from the oxygen sensor changes from lean to rich. Therefore, when the oxygen sensor's output value is fed back to the fuel injection amount to increase or decrease the fuel injection amount in accordance with changes in the oxygen sensor's output value, the oxygen occluded by the catalyst can be maintained in an appropriate state.

Further, it is known that the catalyst's oxygen occlusion capability can be maintained high when the catalyst's noble metal is activated by repeatedly occluding and releasing oxygen. When the catalyst's oxygen occlusion capability is high, oxygen can be occluded or released to purify NOx, HC, and CO in the exhaust gas with high efficiency even if the air-fuel ratio of the exhaust gas is significantly varied from a stoichiometric air-fuel ratio or oscillating with large amplitude. According to fuel injection amount feedback control that is exercised in accordance with the oxygen sensor's output value, the catalyst can repeatedly occlude and release oxygen as the air-fuel ratio of the exhaust gas oscillates around the stoichiometric air-fuel ratio.

Air-fuel ratio control methods for making effective use of a catalyst's oxygen occlusion capability are described in the patent documents enumerated below:

Patent Document 1: JP-A-2002-115590
Patent Document 2: JP-A-2005-188330
Patent Document 3: JP-A-1998-246139

DISCLOSURE OF THE INVENTION

Problem to be Solved by the Invention

However, even when the air-fuel ratio of the exhaust gas is oscillating around the stoichiometric air-fuel ratio, the catalyst's oxygen occlusion capability decreases as far as the oscillation amplitude is small. FIG. 5 is a graph illustrating the relationship between the air-fuel ratio (A/F) of the exhaust gas flowing into the catalyst and the oxygen occlusion amount or oxygen release amount of the catalyst. As indicated in this figure, the oxygen occlusion amount of the catalyst increases with an increase in the degree to which the air-fuel ratio is richer than the stoichiometric air-fuel ratio, whereas the oxygen release amount of the catalyst increases with an increase in the degree to which the air-fuel ratio is leaner than the stoichiometric air-fuel ratio. To put it another way, both the oxygen occlusion amount and oxygen release amount of the catalyst decrease with an increase in the degree to which the air-fuel ratio is close to the stoichiometric air-fuel ratio. Therefore, if the air-fuel ratio persistently oscillates with small amplitude around the stoichiometric air-fuel ratio, only a small amount of oxygen is repeatedly occluded and released so that the catalyst stabilizes while its oxygen occlusion capability is low.

The above-described decrease in the oxygen occlusion capability is temporary. The catalyst's oxygen occlusion capability is restored when the amplitude of the air-fuel ratio becomes large again. However, it takes a certain amount of time for the oxygen occlusion capability to become sufficiently restored. Therefore, if the air-fuel ratio of the exhaust gas suddenly changes due, for instance, to disturbance after having converged to a value close to the stoichiometric air-fuel ratio, it is probable that emissions may be released to the atmosphere beyond the catalyst's purification capacity.

The present invention has been made to solve the above problem. An object of the present invention is to provide an air-fuel ratio control device that is used with an internal combustion engine and capable of maintaining high purification performance by suppressing a decrease in the oxygen occlusion capability of a catalyst.

Means for Solving the Problems

In order to attain the object described above, a first aspect of the present invention is an air-fuel ratio control device for an internal combustion engine having an exhaust path in which a catalyst capable of occluding oxygen is installed, the air-fuel ratio control device comprising:

an oxygen sensor which is installed downstream of the catalyst; and reflection coefficient calculation means for calculating a reflection coefficient, which reflects an output value of the oxygen sensor in the calculation of a fuel injection amount and increases or decreases to have a consequence on the air-fuel ratio of an exhaust gas;

wherein the reflection coefficient calculation means fixes the reflection coefficient at a predetermined value for providing a lean air-fuel ratio when the output value of the oxygen sensor is greater than a reference value corresponding to a stoichiometric air-fuel ratio and smaller than an upper threshold value, and fixes the reflection coefficient at a predetermined value for providing a rich air-fuel ratio when the output value of the oxygen sensor is smaller than the reference value and greater than a lower threshold value.

A second aspect of the present invention is the air-fuel ratio control device according to the first aspect of the present invention, wherein the reflection coefficient calculation means sets the upper threshold value at a value smaller than the maximum output value of the oxygen sensor and the lower threshold value at a value greater than the minimum output value of the oxygen sensor, and increases or decreases the reflection coefficient in accordance with a change in the output value of the oxygen sensor when the output value of the oxygen sensor is greater than the upper threshold value and when the output value of the oxygen sensor is smaller than the lower threshold value.

A third aspect of the present invention is the air-fuel ratio control device according to the second aspect of the present invention, further comprising:

means for measuring the flow rate of an exhaust gas passing through the catalyst;

wherein the reflection coefficient calculation means ensures that the degree of closeness of the upper and lower threshold values to the reference value increases with an increase in the flow rate of the exhaust gas passing through the catalyst.

A fourth aspect of the present invention is the air-fuel ratio control device according to the second aspect of the present invention, further comprising:

means for measuring the flow rate of an exhaust gas passing through the catalyst;

wherein the reflection coefficient calculation means changes the magnitudes of the predetermined values in accordance with the flow rate of an exhaust gas passing through the catalyst to ensure that the amounts of air-fuel ratio lean correction and air-fuel ratio rich correction decrease with an increase in the flow rate of the exhaust gas passing through the catalyst.

A fifth aspect of the present invention is the air-fuel ratio control device according to the second aspect of the present invention, further comprising:

means for measuring the oxygen occlusion capability of the catalyst;

wherein the reflection coefficient calculation means ensures that the degree of closeness of the upper and lower threshold values to the reference value increases with a decrease in the oxygen occlusion capability of the catalyst.

A sixth aspect of the present invention is the air-fuel ratio control device according to the second aspect of the present invention, further comprising:

means for measuring the oxygen occlusion capability of the catalyst;

wherein the reflection coefficient calculation means changes the magnitudes of the predetermined values in accordance with the oxygen occlusion capability of the catalyst to ensure that the amounts of air-fuel ratio lean correction and air-fuel ratio rich correction decrease with a decrease in the oxygen occlusion capability of the catalyst.

A seventh aspect of the present invention is the air-fuel ratio control device according to any one of the first to the sixth aspects of the present invention, wherein another catalyst capable of occluding oxygen is installed downstream of the oxygen sensor; and wherein the reflection coefficient calculation means increases or decreases the reflection coefficient in accordance with a change in the output value of the oxygen sensor for a predetermined period after a fuel cut even when the output value of the oxygen sensor is between the upper threshold value and the lower threshold value.

Advantages of the Invention

According to the first aspect of the present invention, an air-fuel ratio oscillation having an amplitude not smaller than a predetermined value corresponding to oxygen occlusion/release by a catalyst can be imparted to an exhaust gas flowing into the catalyst. This makes it possible to suppress a decrease in the oxygen occlusion capability of the catalyst.

According to the second aspect of the present invention, the range within which a reflection coefficient is fixed in relation to the variation range of an oxygen sensor output value can be limited to prevent the air-fuel ratio from becoming excessively lean or rich and avoid an increase in the inversion frequency of an oxygen sensor output value.

According to the third aspect of the present invention, it is possible to avoid an excessively lean or excessively rich air-fuel ratio and an increase in the inversion frequency of the oxygen sensor output value with increased certainty by reducing the reflection coefficient fixation range in accordance with an increase in the flow rate of an exhaust gas passing through the catalyst and in the rate of oxygen occlusion/release by the catalyst.

According to the fourth aspect of the present invention, it is possible to avoid an excessively lean or excessively rich air-fuel ratio and an increase in the inversion frequency of the oxygen sensor output value with increased certainty by fixing the reflection coefficient to decrease the lean correction amount and rich correction amount of the air-fuel ratio in accordance with an increase in the flow rate of the exhaust gas passing through the catalyst and in the rate of oxygen occlusion/release by the catalyst.

According to the fifth aspect of the present invention, it is possible to avoid an excessively lean or excessively rich air-fuel ratio and an increase in the inversion frequency of the oxygen sensor output value with increased certainty by reducing the reflection coefficient fixation range in accordance with a decrease in the oxygen occlusion capability of the catalyst.

According to the sixth aspect of the present invention, it is possible to avoid an excessively lean or excessively rich air-fuel ratio and an increase in the inversion frequency of the oxygen sensor output value with increased certainty by fixing the reflection coefficient to decrease the lean correction amount and rich correction amount of the air-fuel ratio in accordance with a decrease in the oxygen occlusion capability of the catalyst.

According to the seventh aspect of the present invention, it is possible to avoid an excessively lean air-fuel ratio immediately after an oxygen sensor output change to a rich output by increasing or decreasing the reflection coefficient, immediately after a fuel cut, in accordance with a change in the oxygen sensor output value instead of using a fixed reflection coefficient. The downstream catalyst, which is positioned downstream of the oxygen sensor, is saturated with oxygen due to the fuel cut. However, if an excessively lean exhaust gas flows into the downstream catalyst in the above state, NOx in the exhaust gas is released to the atmosphere without being purified by the downstream catalyst. The seventh aspect of the present invention makes it possible to avoid such a situation.

DESCRIPTION OF NOTATIONS

2 internal combustion engine
4 exhaust path
6,8 catalyst
10 ECU
12 A/F sensor (wide-range air-fuel ratio sensor)
14 $O_2$ sensor (oxygen sensor)

BEST MODE OF CARRYING OUT THE INVENTION

An embodiment of the present invention will now be described with reference to the accompanying drawings.

Figure 1:
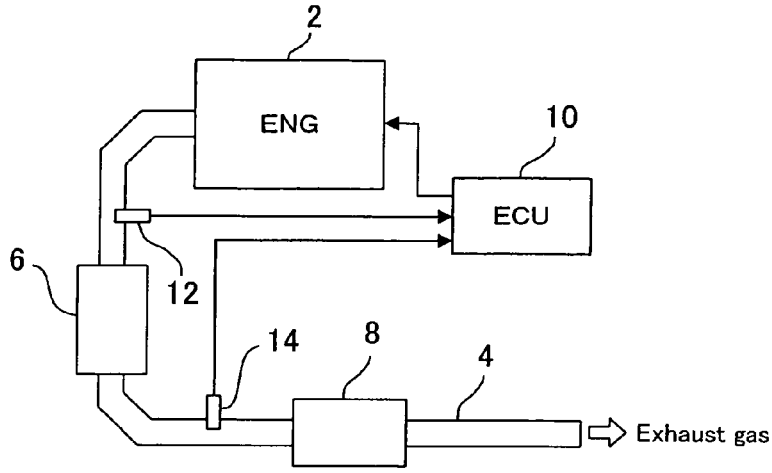
FIG. 1 is a diagram illustrating the configuration of an internal combustion engine to which an air-fuel ratio control device according to an embodiment of the present invention is applied.

FIG. 1 is a diagram illustrating the overall configuration of an internal combustion engine (hereinafter referred to as the engine) to which an air-fuel ratio control device according to an embodiment of the present invention is applied. As shown in the figure, an engine main body 2 is connected to an exhaust path 4. Two catalysts 6, 8 are installed in the exhaust path 4 to form two catalyst stages for purifying harmful components (NOx, CO, and HC) of an exhaust gas. Both of these catalysts 6, 8 have an oxygen occlusion capability. The upstream catalyst 6 is positioned close to an exhaust manifold, whereas the downstream catalyst 8 is positioned beneath the floor of a vehicle. An A/F sensor (wide-range air-fuel ratio sensor) 12 is installed upstream of the catalyst 6. An $O_2$ sensor (oxygen sensor) 14 is installed downstream of the catalyst 6. The A/F sensor 12 generates an output that is linear with respect to the air-fuel ratio. The $O_2$ sensor 14 outputs a signal that corresponds to the concentration of oxygen in the gas. The output characteristic of the $O_2$ sensor 14 is such that its output value varies with the air-fuel ratio and inverts with respect to a stoichiometric air-fuel ratio.

The engine includes an ECU (Electronic Control Unit) 10 as a control device that provides total control over the entire system operation. The above-described A/F sensor 12 and $O_2$ sensor 14 are connected to the ECU 10. In accordance with the output values generated from the A/F sensor 12 and $O_2$ sensor 14, the ECU 10 exercises fuel injection amount feedback control so that the air-fuel ratio of the exhaust gas flowing into the catalyst 6 agrees with the stoichiometric air-fuel ratio. This feedback control is referred to as air-fuel ratio feedback control.

Air-fuel ratio feedback control, which is exercised by the ECU 10, is divided into main feedback control and sub-feedback control. When main feedback control is exercised, the output value of the A/F sensor 12 is reflected in the fuel injection amount. When sub-feedback control is exercised, the output value of the $O_2$ sensor 14 is reflected in the fuel injection amount. Air-fuel ratio feedback control based on A/F sensor 12 and $O_2$ sensor 14 will not be described in detail in this document because it is publicly known.

When air-fuel ratio feedback control is exercised, the air-fuel ratio of the exhaust gas is maintained close to the stoichiometric air-fuel ratio. At the same time, however, the amount of oxygen occlusion/release decreases to reduce the oxygen occlusion capability of the catalyst 6 so that emissions are unexpectedly discharged from the catalyst 6 even when the air-fuel ratio slightly changes. In view of the above circumstances, the ECU 10 performs a process for oscillating the air-fuel ratio with an amplitude not smaller than a predetermined value without converging it during air-fuel ratio feedback control.

A process performed by the ECU 10 in accordance with the present embodiment will now be described. The ECU 10 exercises sub-feedback control to perform a process for oscillating the air-fuel ratio with an amplitude not smaller than a predetermined value. Conventional sub-feedback control is exercised so as to calculate the deviation between the output value of the $O_2$ sensor 14 and a reference value, which is equivalent to the stoichiometric air-fuel ratio, and use the calculated deviation to excise P control, PI control, or PID control for the purpose of calculating a sub-FB reflection coefficient. The amount of corrective increase in the fuel injection amount increases with an increase in the sub-FB reflection coefficient when it is a positive valve. Such a corrective increase enriches the air-fuel ratio. In contrast, the amount of corrective decrease in the fuel injection amount increases with a decrease in the sub-FB reflection coefficient when it is a negative valve. Such a corrective decrease enleans the air-fuel ratio of the exhaust gas.

Sub-feedback control according to the present embodiment is characterized by a sub-FB reflection coefficient setting or, more particularly, a proportional term setting related to P control. When PI control and PID control are exercised as sub-feedback control, an integral term and a derivative term exist in addition to the proportional term. However, their settings are not limited. The following explanation ignores the integral term and derivative term, and assumes that the word "sub-FB reflection coefficient" represents the proportional term only.

Figure 2:
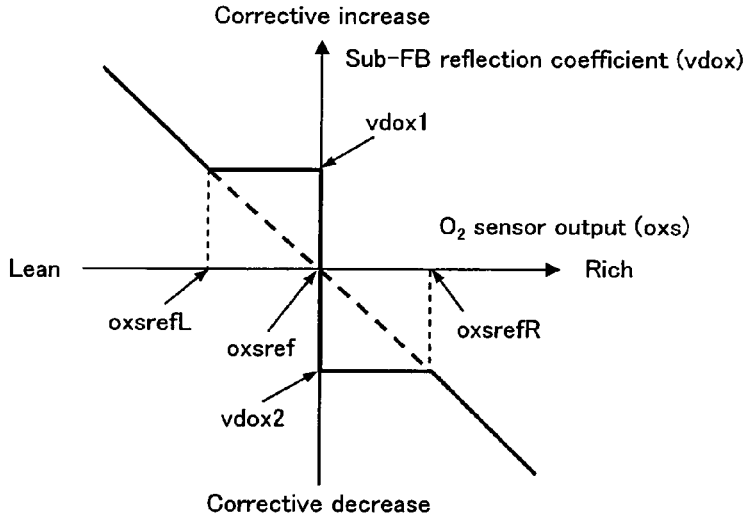
FIG. 2 is a diagram illustrating the relationship between the sub-FB reflection coefficient and the output value of the $O_2$ sensor set out in an embodiment of the present invention.

FIG. 2 is a diagram illustrating the relationship between the sub-FB reflection coefficient and the output value of the $O_2$ sensor 14 ($O_2$ sensor output). A characteristic line in FIG. 2, which is indicated by a broken line, indicates the relationship between a sub-FB reflection coefficient setting for conventional sub-feedback control and the output value of the $O_2$ sensor 14. A conventional setup is such that the sub-FB reflection coefficient is directly proportional to the output deviation between the output value of the $O_2$ sensor 14 and a reference value oxsref within the entire range of the output value of the $O_2$ sensor 14. On the other hand, the present embodiment assumes that the sub-FB reflection coefficient is fixed at a predetermined value vdox2 without regard to the output value of the $O_2$ sensor 14 when the output value of the $O_2$ sensor 14 is greater than the reference value oxsref and smaller than an upper threshold value oxsrefR, as shown by solid lines in FIG. 2. This predetermined value vdox2 is a sub-FB reflection coefficient value for conventional control that corresponds to the upper threshold value oxsrefR. Further, the present embodiment assumes that the sub-FB reflection coefficient is fixed at a predetermined value vdox1 without regard to the output value of the $O_2$ sensor 14 when the output value of the $O_2$ sensor 14 is not greater than the reference value oxsref and is greater than a lower threshold value oxsrefL. This predetermined value vdox1 is a sub-FB reflection coefficient value for conventional control that corresponds to the lower threshold value oxsrefL. When the output value of the $O_2$ sensor 14 is not smaller than the upper threshold value oxsrefR or not greater than the lower threshold value oxsrefL, the present embodiment is the same as the conventional setup; in those cases, the sub-FB reflection coefficient is directly proportional to the output deviation between the output value of the $O_2$ sensor 14 and the reference value oxsref.

Figure 3:
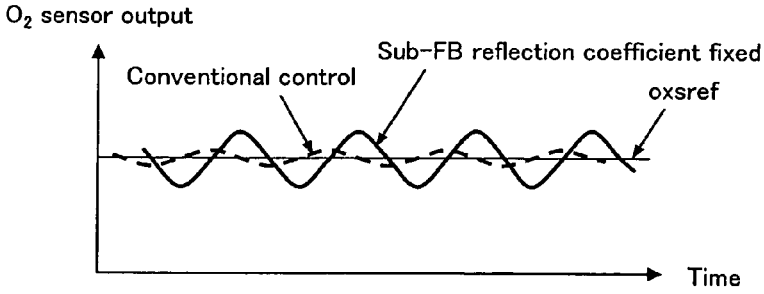
FIG. 3 shows a comparison between the output value of the $O_2$ sensor that prevails when the sub-FB reflection coefficient is set out as shown in FIG. 2 and the output value of the $O_2$ sensor that prevails when conventional control is exercised.

FIG. 3 shows a comparison between the output value of the $O_2$ sensor 14 (indicated by a solid line in the figure) that prevails when the above process is performed and the output value of the $O_2$ sensor 14 (indicated by a broken line in the figure) that prevails when conventional control is exercised. When conventional control is exercised, the output value of the $O_2$ sensor 14 converges to the reference value oxsref before long. When, on the other hand, the above process is performed, the magnitude of the sub-FB reflection coefficient to be reflected in the fuel injection amount does not decrease below the values vdox1 and vdox2. Therefore, the air-fuel ratio of the exhaust gas flowing into the catalyst 6 constantly oscillates with an amplitude not smaller than a predetermined value, thereby causing the output value of the $O_2$ sensor 14 to constantly oscillate with an amplitude not smaller than a predetermined value. In addition, the output value of the $O_2$ sensor 14 inverts when the catalyst 6 occludes/releases oxygen. Therefore, the air-fuel ratio oscillation imparted by the above process is in agreement with oxygen occlusion/release by the catalyst 6. When the air-fuel ratio oscillation having an amplitude not smaller than a predetermined value in response to oxygen occlusion/release by the catalyst 6 is constantly imparted to the exhaust gas as described above, the catalyst 6 can constantly occlude/release oxygen in an amount not smaller than a predetermined value, thereby suppressing a decrease in the oxygen occlusion capability of the catalyst 6.

The difference between the upper threshold value oxsrefR and the reference value oxsref is set to be approximately 60% of the difference between the maximum output value of the $O_2$ sensor 14 and the reference value oxsref. The difference between the lower threshold value oxsrefL and the reference value oxsref is set to be approximately 60% of the difference between the minimum output value of the $O_2$ sensor 14 and the reference value oxsref. The sub-FB reflection coefficient is not fixed within the entire range of the output value of the $O_2$ sensor 14, but fixed limitedly within a 0 to 60% range of the output deviation for the purpose of avoiding an excessively lean or excessively rich air-fuel ratio and an excessively high inversion frequency of the output value of the $O_2$ sensor 14.

From the viewpoint of avoiding an excessively lean or excessively rich air-fuel ratio and a high inversion frequency of the output value of the $O_2$ sensor 14, it is preferred that the upper threshold value oxsrefR and lower threshold value oxsrefL come close to the reference value oxsref with an increase in the flow rate of the exhaust gas passing through the catalyst 6, that is, with an increase in the rate of oxygen occlusion/release by the catalyst 6. It is also preferred that the upper threshold value oxsrefR and lower threshold value oxsrefL come close to the reference value oxsref with a decrease in the oxygen occlusion capacity of the catalyst 6, that is, with an increase in the degree of deterioration of the catalyst 6.

Similarly, from the viewpoint of avoiding an excessively lean or excessively rich air-fuel ratio and a high inversion frequency of the output value of the $O_2$ sensor 14, it is preferred that the absolute values of the fixed values vdox1, vdox2 of the sub-FB reflection coefficient decrease with an increase in the flow rate of the exhaust gas passing through the catalyst 6. It is also preferred that the absolute values of the fixed values vdox1, vdox2 decrease with a decrease in the oxygen occlusion capacity of the catalyst 6. The flow rate of the exhaust gas can be measured with an intake air amount sensor that is positioned in an intake path. The flow rate of the exhaust gas passing through the catalyst 6 can be determined by performing a first-order lag process, which depends on a transport lag between the intake air amount sensor and catalyst, on the output value of the intake air amount sensor. The oxygen occlusion capacity of the catalyst 6 can be calculated from the inversion frequency of the output value of the $O_2$ sensor 14. The lower the inversion frequency, the smaller the oxygen occlusion capacity of the catalyst 6.

Figure 4:
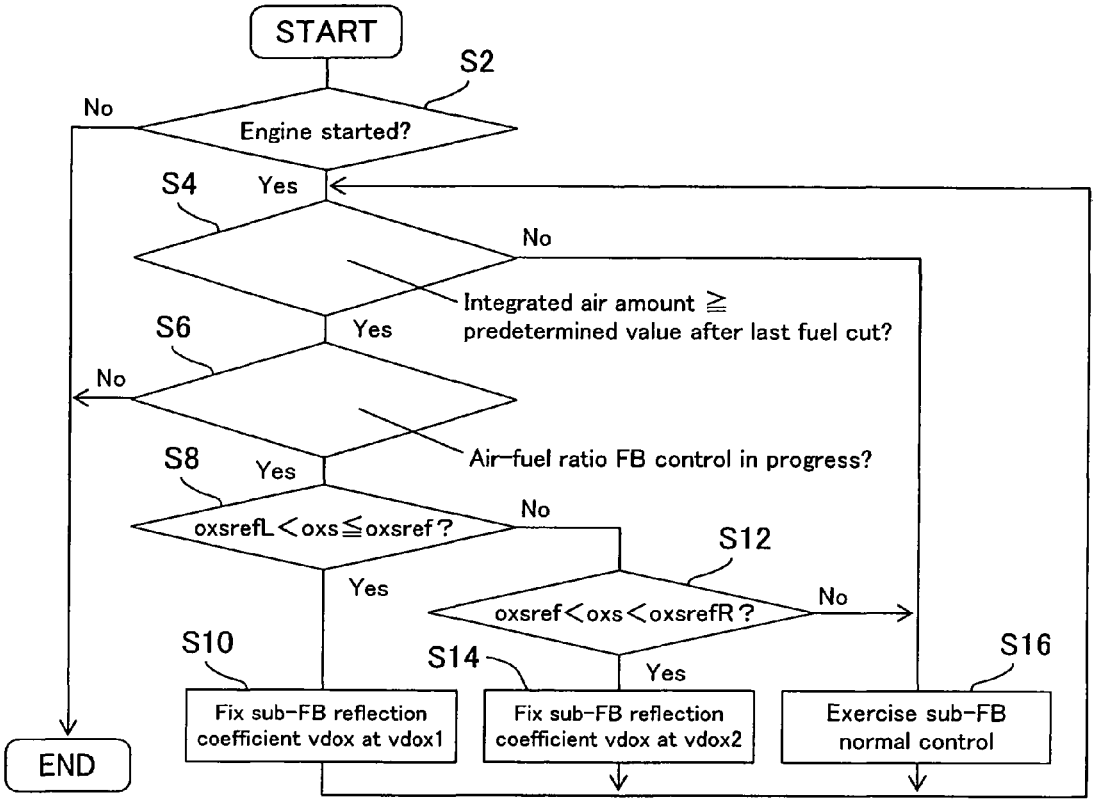
FIG. 4 is a flowchart that shows a routine executed in an embodiment of the present invention.
Figure 5:
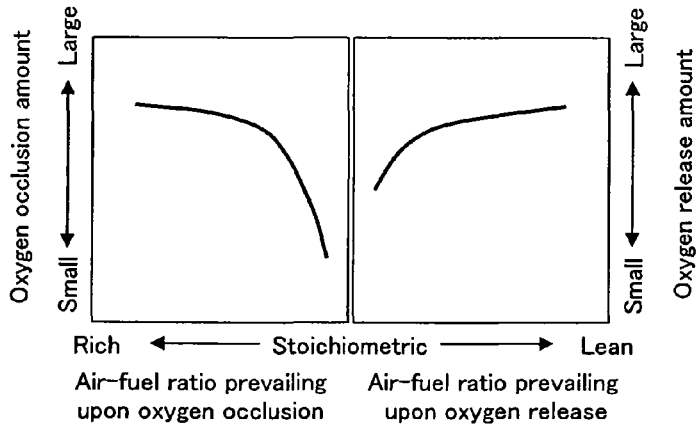
FIG. 5 is a graph illustrating the relationship between the air-fuel ratio of the exhaust gas flowing into the catalyst and the oxygen occlusion amount or oxygen release amount of the catalyst.

More specifically, the above-described process is performed in accordance with the flowchart shown in FIG. 4. The ECU 10 executes a routine shown in FIG. 4 as part of sub-feedback control, and exercises sub-feedback control by using the sub-FB reflection coefficient determined by the routine. In the present embodiment, the "reflection coefficient calculation means" according to the present invention is implemented when the ECU 10 executes the routine described below.

Step S2, which is the first step of the routine shown in FIG. 4, is performed to judge whether the engine is started. If the engine is not started, the routine terminates without performing the subsequent steps. If, on the other hand, the engine is started, the routine proceeds to step 4, which is the next judgment step.

Step S4 is performed to calculate the integrated value of the intake air amount that is reached after the last fuel cut, and compare the calculated integrated value against a predetermined reference value. Performing a fuel cut saturates both catalysts 6, 8 with oxygen because air flows into them. After completion of recovery from a fuel cut, the air-fuel ratio of the exhaust gas becomes rich because the output value of the $O_2$ sensor 14 indicates a lean output. Subsequently, the upstream catalyst 6 becomes desaturated with oxygen, and then the downstream catalyst 8 becomes desaturated with oxygen. However, when the sub-FB reflection coefficient is to be fixed as indicated by the solid lines in FIG. 2, the exhaust gas may become excessively lean in accordance with a significant decrease in the fuel injection amount immediately after the upstream catalyst 6 is desaturated with oxygen with the output value of the $O_2$ sensor 14 changed to a rich output. When such an excessively lean exhaust gas passes through the upstream catalyst 6 and flows into the downstream catalyst 8, which is still saturated with oxygen, NOx in the exhaust gas is released to the atmosphere without being purified by the catalyst 8.

Therefore, if the judgment result obtained in step S4 indicates that the integrated value of the intake air amount is smaller than the predetermined value, the routine proceeds to step S16. Step S16 is performed to exercise normal sub-feedback control (sub-FB normal control). More specifically, the sub-FB reflection coefficient is set in such a manner that it is directly proportional to the output deviation between the output value of the $O_2$ sensor 14 and the reference value oxsref within the entire range of the output value of the $O_2$ sensor 14 as indicated by the broken line in FIG. 2. When the sub-FB reflection coefficient is increased or decreased immediately after a fuel cut in accordance with a change in the output value of the $O_2$ sensor 14 without being set at a fixed value, as described above, it is possible to prevent the air-fuel ratio from becoming excessively lean immediately after a change in the output value of the $O_2$ sensor 14 to a rich output. If, on the other hand, the judgment result obtained in step S4 indicates that the integrated value of the intake air amount, which is reached after the last fuel cut, is not smaller than the predetermined value, the routine proceeds to step S6 for another judgment.

Step S6 is performed to judge whether air-fuel ratio feedback control is being exercised. If the judgment result obtained in step S6 does not indicate that air-fuel ratio feedback control is being exercised, the routine terminates. If, on the other hand, air-fuel ratio feedback control is being exercised, the routine determines the sub-FB reflection coefficient by performing steps S8, S10, S12, S14, and S16.

First of all, step S8 is performed to judge whether the output value oxs of the $O_2$ sensor 14 is between the lower threshold value oxsrefL and the reference value oxsref. If the output value oxs of the $O_2$ sensor 14 is within that range, the routine proceeds to step S10 and fixes the sub-FB reflection coefficient at the aforementioned predetermined value vdox1. If, on the other hand, the output value oxs of the $O_2$ sensor 14 is outside the above range, the routine proceeds to step S12 for another judgment.

Step S12 is performed to judge whether the output value oxs of the $O_2$ sensor 14 is between the reference value oxsref and the upper threshold value oxsrefR. If the output value oxs of the $O_2$ sensor 14 is within that range, the routine proceeds to step S14 and fixes the sub-FB reflection coefficient at the aforementioned predetermined value vdox2. If, on the other hand, the output value oxs of the $O_2$ sensor 14 is outside the above range, that is, the output value oxs of the $O_2$ sensor 14 is not greater than the lower threshold value oxsrefL or not smaller than the upper threshold value oxsrefR, the routine proceeds to step S16 and exercises normal sub-feedback control.

While the present invention has been described in terms of a preferred embodiment, persons of skill in the art will appreciate that the present invention is not limited to the preferred embodiment, and that various changes and modifications may be made without departing from the spirit and scope of the invention. For example, the following modifications may be made to the preferred embodiment of the present invention.

An $O_2$ sensor may be installed upstream of the catalyst 6 instead of the A/F sensor 12, as is the case with the sensor installed downstream of the catalyst 6. The $O_2$ sensor 14 installed downstream of the catalyst 6 may instead be installed downstream of the downstream catalyst 8. Further, the present invention can also be applied to a system in which an $O_2$ sensor 14 is installed downstream of the catalyst 6, but no A/F sensor 12 is installed upstream of the catalyst 6.

The invention claimed is:

1. An air-fuel ratio control device for an internal combustion engine having an exhaust path in which a catalyst capable of occluding oxygen is installed, the air-fuel ratio control device comprising:

an oxygen sensor which is installed downstream of the catalyst; and reflection coefficient calculation means for calculating a reflection coefficient, which reflects an output value of the oxygen sensor in the calculation of a fuel injection amount and increases or decreases to have a consequence on the air-fuel ratio of an exhaust gas;

wherein the reflection coefficient calculation means fixes the reflection coefficient at a predetermined value for providing a lean air-fuel ratio when the output value of the oxygen sensor is greater than a reference value corresponding to a stoichiometric air-fuel ratio and smaller than an upper threshold value set at a value smaller than the maximum output value of the oxygen sensor, and fixes the reflection coefficient at a predetermined value for providing a rich air-fuel ratio when the output value of the oxygen sensor is smaller than the reference value and greater than a lower threshold value set at a value greater than the minimum output value of the oxygen sensor, and increases or decreases the reflection coefficient in accordance with a change in the output value of the oxygen sensor when the output value of the oxygen sensor is greater than the upper threshold value and when the output value of oxygen sensor is smaller than the lower threshold value.

2. The air-fuel ratio control device according to claim 1, further comprising:

means for measuring the flow rate of an exhaust gas passing through the catalyst;

wherein the reflection coefficient calculation means ensures that the degree of closeness of the upper and lower threshold values to the reference value increases with an increase in the flow rate of the exhaust gas passing through the catalyst.

3. The air-fuel ratio control device according to claim 1, further comprising:

means for measuring the flow rate of an exhaust gas passing through the catalyst;

wherein the reflection coefficient calculation means changes the magnitudes of the predetermined values in accordance with the flow rate of an exhaust gas passing through the catalyst to ensure that the amounts of air-fuel ratio lean correction and air-fuel ratio rich correction decrease with an increase in the flow rate of the exhaust gas passing through the catalyst.

4. The air-fuel ratio control device according to claim 1, further comprising:

means for measuring the oxygen occlusion capability of the catalyst;

wherein the reflection coefficient calculation means ensures that the degree of closeness of the upper and lower threshold values to the reference value increases with a decrease in the oxygen occlusion capability of the catalyst.

5. The air-fuel ratio control device according to claim 1, further comprising:

means for measuring the oxygen occlusion capability of the catalyst;

wherein the reflection coefficient calculation means changes the magnitudes of the predetermined values in accordance with the oxygen occlusion capability of the catalyst to ensure that the amounts of air-fuel ratio lean correction and air-fuel ratio rich correction decrease with a decrease in the oxygen occlusion capability of the catalyst.

6. The air-fuel ratio control device according to claim 1, wherein another catalyst capable of occluding oxygen is installed downstream of the oxygen sensor; and wherein the reflection coefficient calculation means increases or decreases the reflection coefficient in accordance with a change in the output value of the oxygen sensor for a predetermined period after a fuel cut even when the output value of the oxygen sensor is between the upper threshold value and the lower threshold value.

7. An air-fuel ratio control device for an internal combustion engine having an exhaust path in which a catalyst capable of occluding oxygen is installed, the air-fuel ratio control device comprising:

an oxygen sensor which is installed downstream of the catalyst; and a data processor for calculating a reflection coefficient, which reflects an output value of the oxygen sensor in the calculation of a fuel injection amount and increases or decreases to have a consequence on the air-fuel ratio of an exhaust gas;

wherein the data processor fixes the reflection coefficient at a predetermined value for providing a lean air-fuel ratio when the output value of the oxygen sensor is greater than a reference value corresponding to a stoichiometric air-fuel ratio and smaller than an upper threshold value set at a value smaller than the maximum output value of the oxygen sensor, fixes the reflection coefficient at a predetermined value for providing a rich air-fuel ratio when the output value of the oxygen sensor is smaller than the reference value and greater than a lower threshold value set at a value greater than the minimum output value of the oxygen sensor, and increases or decreases the reflection coefficient in accordance with a change in the output value of the oxygen sensor when the output value of the oxygen sensor is greater than the upper threshold value and when the output value of the oxygen sensor is smaller than the lower threshold value.

* * * * *